US006237802B1

(12) United States Patent
Douglas

(10) Patent No.: US 6,237,802 B1
(45) Date of Patent: May 29, 2001

(54) ANGLED-CUT PAINT BRUSH HOLDER

(75) Inventor: Randall Cecil Douglas, Silver Spring, MD (US)

(73) Assignee: Randall Douglas

( * ) Notice: Subject to any disclaimer, the term of this patent is extended or adjusted under 35 U.S.C. 154(b) by 0 days.

(21) Appl. No.: 09/548,282

(22) Filed: Apr. 12, 2000

(51) Int. Cl.[7] ..... B65D 25/20
(52) U.S. Cl. ..... 220/736
(58) Field of Search ..... 220/736, 570, 220/482, 480

(56) References Cited

U.S. PATENT DOCUMENTS 1,008,856 * 11/1911 Mosher ..... 220/736
1,748,789 * 2/1930 Orkin ..... 220/736
4,436,217 * 3/1984 Ritter ..... 220/736
5,038,955 * 8/1991 Studer et al. ..... 220/736
5,072,868 * 12/1991 Dickie et al. ..... 220/736
5,687,873 * 11/1997 Jones ..... 220/736
5,791,534 * 8/1998 Davis et al. ..... 220/736

* cited by examiner

*Primary Examiner*—Joseph M. Moy

(57) ABSTRACT

An angled-cut paint brush holder that is attached to the outer portion of a paint container is disclosed. The holder comprises a brush vessel having an angle shape opening formed by a tall inside wall and three short exterior walls toward the bottom cover. The inside wall of the brush vessel has a guide to secure the brush handle, envelops over the open top rim of the paint container, so that the vessel is placed vertically along side the paint container, extending to the bottom edge of the container.

3 Claims, 2 Drawing Sheets

ANGLED-CUT PAINT BRUSH HOLDER

BACKGROUND OF INVENTION

1. Field of Invention

The present invention generally relates to the field of paint brush apparatus. In particular, the present invention is concerned with a paint brush holder attachable to the outer portion of a paint container.

2. Description of Prior Art

Paintbrush holders supported by a paint container have long been known in the art. A variety of basic styles have been proposed for supporting a paint brush holder adjacent to the paint container. Some with wide opening, some with narrow opening; some situated high on the container, while others situated low on the container. There are few patents in the field with appropriate size (wide) of open top vessel so as to easily accommodate the paint brush and at the same time be bristle friendly. Examples of these are U.S. Pat. Nos. 4,583,666; 5,261,577; 5,322,183. Although these patents make insertion of the brush quite easy, they fall short in situating the brush in a position which is safe from obstruction and accidents and the like. These allow the paint brush to rest in a presumptuous position which extends only above or away from the paint container thus making it less safe for the user. When the body of the brush is not aligned with the body of the paint container upon which it is mounted, it is prone to be knocked out of its resting position and could cause accidents and the like.

BRIEF SUMMARY OF THE INVENTION

An object of this invention is to create appropriate space in an open top paint brush vessel for easier insertion of a paint brush having a particular size, while at the same time allowing the paint brush holder to be vertically positioned close to the paint container, so that the paint brush would not extend much above or away from the container, thus avoiding obstruction. This occurs when the open top vessel (brush holder) is situated all the way down to the bottom rim of the paint container.

It is a further object of the invention to provide such a paint brush holder with a "C" shape guide for securing the handle of the paint brush in its resting position.

BRIEF DESCRIPTION OF THE DRAWINGS

The drawings illustrate embodiments of the present invention in which.

DESCRIPTION OF THE PREFERRED EMBODIMENT

Figure 1:
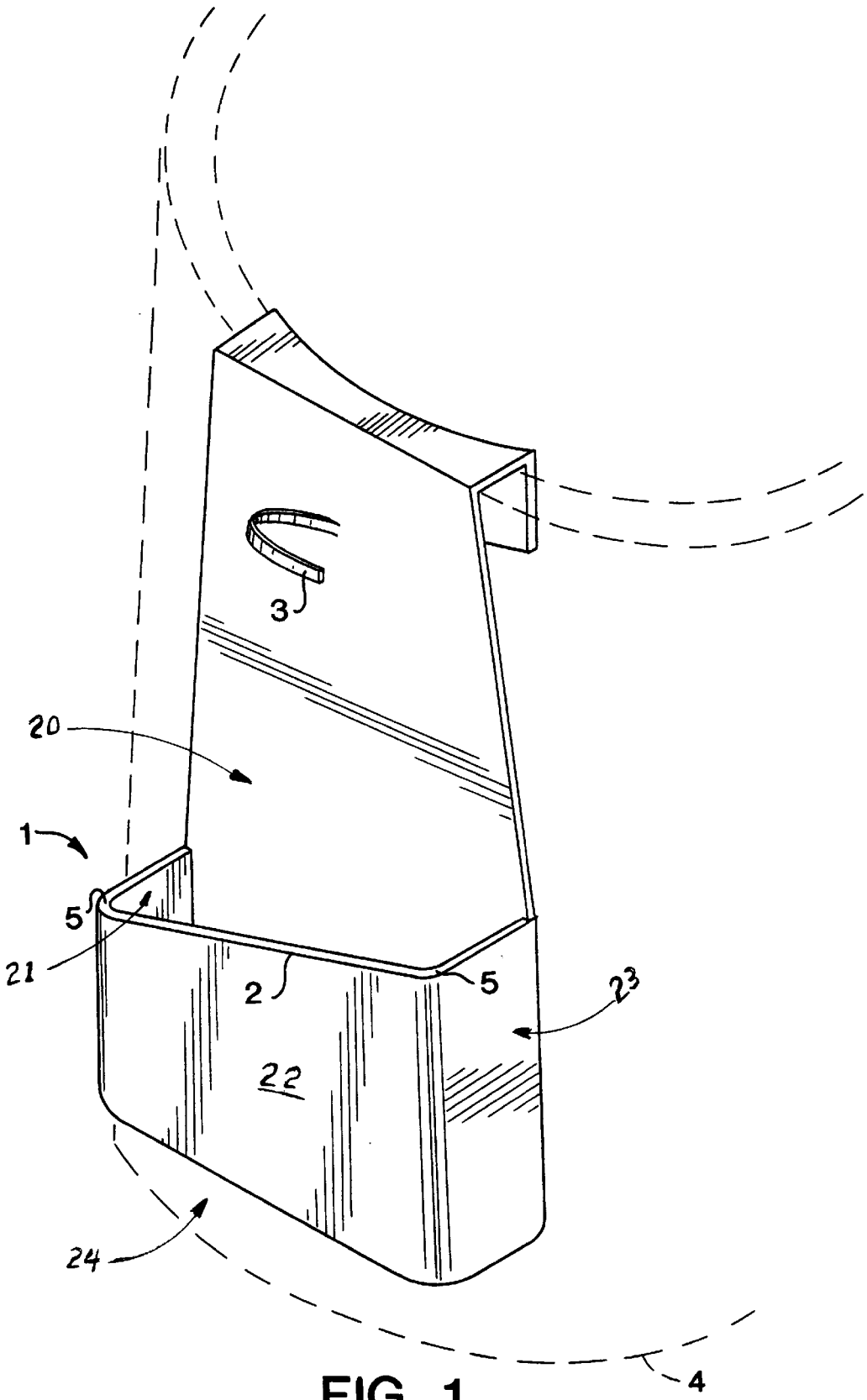
FIG. 1 is a perspective view, showing in phantom lines the article on which it is intended to be mounted.
Figure 4:
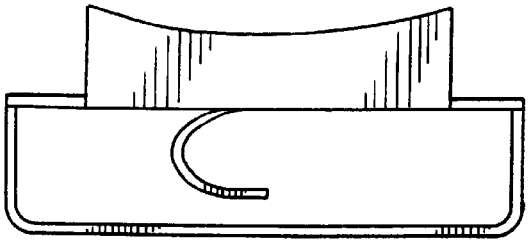
FIG. 4 is a top plan view of the article shown in FIG. 1.
Figure 2:
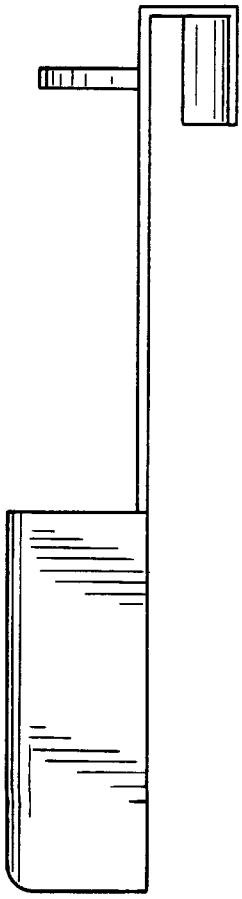
FIG. 2 is a side view of the article shown in FIG. 1.
Figure 3:
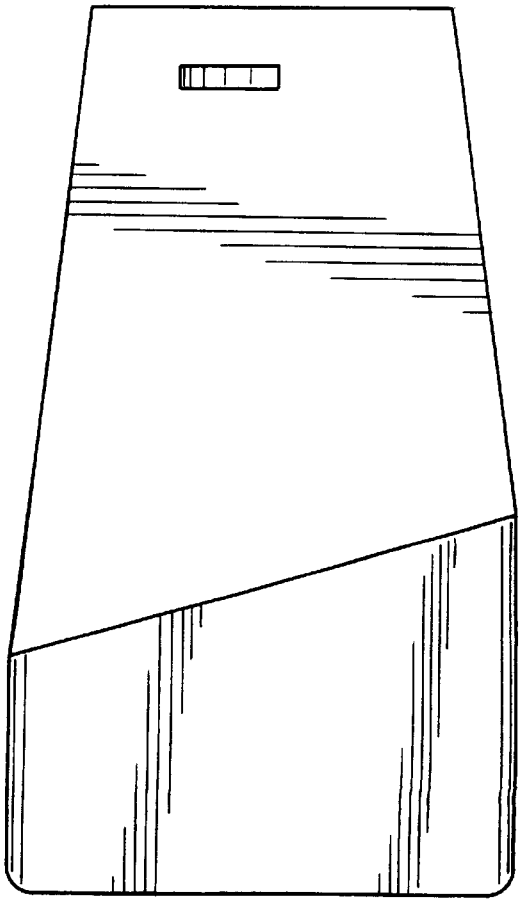
FIG. 3 is a front view of the article shown in FIG. 1.

Now, the first embodiment of the invention will be described with reference to the drawings. FIG. 1 shows an overall view of an angled-cut brush holder or vessel 20 which includes an inside wall 21 a left side low wall 23 a right side higher wall and 22 a front panel joining walls 21 and 23 with 24 a bottom cover.

Continuing in FIG. 1 the brush holder shows 1 a slash angle opening at the top of the vessel area, so as to make insertion of the paint brush easier and to preserve the brush for a longer period of use. There lies a sturdy rim 2 which borders atop the walls 21, 22 and 23 for structural strength and for supporting disposable inserts that might be in use 3 discloses a "c" shape clip designed to secure the brush handle so that the brush would not fall while the paint container is in motion. The bottom cover 24 of the brush holder is positioned all the way down to the bottom edge 4 of the paint container illustrated by phantom lines. 5 refer to the round corners of wall 22 which adjoins walls 21 and 23 so that dried paint or wet paint can easier be removed during the cleaning up period. Paint tends to hold firmer in 90-degree angle corners.

This invention can be made in various sizes and strengths or thicknesses. When sizes are given in width, a 3½ size can accommodate a 3-inch paint brush and a 4-inch size will accommodate a 3½ size paint brush. This invention can be made from various manufacturing materials. Plastic (polypropylene) product can be used, using the process of injection molding. Alloy metal and other types of metal such as aluminum can also be used. This invention can be produced in various strengths: lightweight plastic units can be used once or twice are considered disposable and heavy weight units which are for professional use will be considered permanent. This product can also be manufactured in variety of colors to make this product highly visible on the job.

Having thus described my invention what I claim is:

1. An angled-cut paint brush holder attachable to the outer portion of a paint container having an inside wall hovering over the open top rim of the paint container, the angled-cut paint brush holder comprising:

a brush container, the brush container comprising a vessel having an angled-cut opening, an inside wall having a top edge, opposing side walls, an outside wall, and a bottom cover;

a C shape handle guide situated high on the inner wall of the brush container.

2. The angled-cut paint brush holder as defined in claim 1 wherein:

the opposed side walls of the vessel have unparalleled sizes since the left wall is lower than the right.

3. The paint brush holder as defined in claim 1 further comprising:

a brush vessel which extends from top rim of paint container down to the bottom rim of the same thereof.

* * * * *